US006851517B1

(12) United States Patent
Distler

(10) Patent No.: US 6,851,517 B1
(45) Date of Patent: Feb. 8, 2005

(54) EMERGENCY TOWER ESCAPE SYSTEM FOR A BUILDING HAVING MULTIPLE FLOORS

(76) Inventor: Janet S. Distler, 889-4 Montauk Hwy., East Patchogue, NY (US) 11772

( * ) Notice: Subject to any disclaimer, the term of this patent is extended or adjusted under 35 U.S.C. 154(b) by 0 days.

(21) Appl. No.: 10/244,278

(22) Filed: Sep. 16, 2002

(51) Int. Cl.[7] ..... A62B 1/20
(52) U.S. Cl. ..... 182/48
(58) Field of Search ..... 182/48; 52/187; 446/462, 444; 104/53, 54, 84

(56) References Cited

U.S. PATENT DOCUMENTS

| | | | | |
|---|---|---|---|---|
| 3,831,711 A | | 8/1974 | Smith | |
| 3,915,258 A | * | 10/1975 | Nusslein | 182/48 |
| 3,944,021 A | | 3/1976 | Smith, Jr. et al. | |
| 3,968,856 A | * | 7/1976 | Keen et al. | 182/48 |
| 3,980,155 A | | 9/1976 | Campbell | |
| 4,049,080 A | * | 9/1977 | Suzuki | 182/48 |
| 4,125,172 A | * | 11/1978 | Hatala | 182/19 |
| 4,167,224 A | * | 9/1979 | Kinase et al. | 182/48 |
| 4,207,965 A | * | 6/1980 | Chiang-Cheng et al. | 182/13 |
| 4,267,900 A | | 5/1981 | Yin-Lung | |
| 4,556,123 A | | 12/1985 | Hargest, III | |
| 4,865,155 A | | 9/1989 | Montaigne et al. | |
| 5,127,491 A | | 7/1992 | Just-Buddy | |
| 5,143,172 A | * | 9/1992 | Rhoads | 182/100 |
| 5,377,778 A | * | 1/1995 | Lan | 182/48 |
| 6,467,575 B1 | * | 10/2002 | Chen | 182/48 |

FOREIGN PATENT DOCUMENTS

GB 2101054 A * 1/1983 ..... A62B/1/20

* cited by examiner

*Primary Examiner*—Hugh B. Thompson, II

(57) ABSTRACT

An emergency tower system for a building having multiple floors. A plurality of bridgewalks extends from a plurality of towers to the multiple floors off the building, respectively. A plurality of towers includes an outer shell walls rising parallel to, and spaced from, the building and having a plurality of entrances that align and communicate with the multiple floors of the building, respectively, by a plurality of bridgewalks, respectively, a plurality of spiral chutes which are built entirely within the interior shell wall structures of a plurality of towers and communicating with the plurality of entrances, respectively, so as to allow access thereto from the plurality of bridgewalks, respectively, and which are either concentrically or tandemly disposed to each other, a plurality of tracks built into the plurality of spiral chutes, respectively, and a plurality of cars running on a plurality of spiral tracks and carrying evacuees from a plurality of bridgewalks down the plurality of spiral tracks to safety.

10 Claims, 3 Drawing Sheets

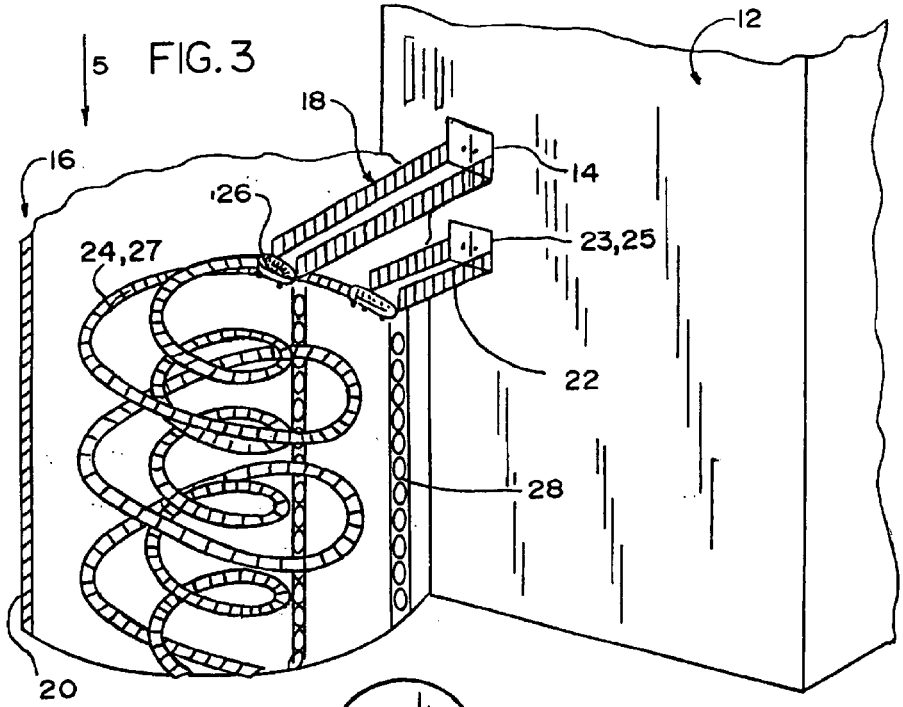
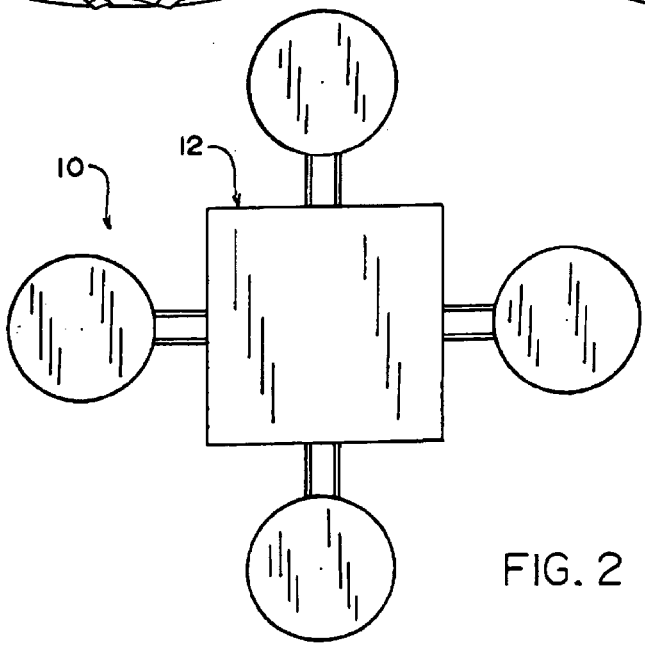
FIG. 2

EMERGENCY TOWER ESCAPE SYSTEM FOR A BUILDING HAVING MULTIPLE FLOORS

BACKGROUND OF THE INVENTION

1. Field of the Invention

The present invention relates to an emergency tower escape system. More particularly, the present invention relates to an emergency tower escape system for a building having multiple floors. A plurality of spiral chutes which are built into a plurality of towers operate in unison as egress units for the emergency egress of occupants of a building having multiple floors.

2. Description of Prior Art

Numerous innovations for emergency escape systems have been provided in the prior art that will be described. Even though these innovations may be suitable for the specific individual purposes to which they address, however, they differ from the present invention.

A First Example, U.S. Pat. No. 3,831,711 to Smith teaches a transport or escape device, particularly adaptable for use in modern high rise building, and skyscrapers, as an escape route for use in the rescue of people who may be trapped and prevented from using the conventional stairways and elevators due to some injury, or natural or man-made disaster such as fire, elevator failure, building collapse, etc. The apparatus, or device, particularly useful as a fire escape, comprises the combination of a channel member installed upon the wall of a building which serves as a way, or rail for a roller chain, adapted to carry personnel escorts or carriers. The roller chain is meshed with a sprocket, or sprockets, powered by appropriate motor means such that the roller chain, provided with one or a plurality of personnel escorts or carriers fitted thereto via appropriate connecting means, can be guided and transported via the channel member, or rail, up the wall of the building from a lower level, e.g., ground level, to a higher level, e.g., the roof of the building, and then returned in similar manner. For example, empty personnel escorts can be conveyed to the roof of the building, loaded with people, and then returned to ground level. Suitably, the roller chain is stored upon a drum from which it can be unwound for use, and then rewound for storage. The channel member, or rail, is generally permanently mounted on a wall of the building, while other components can be either permanently mounted, or transportably mounted on a vehicle for use at different locations equipped with the channel members, or rails, installed prior to any emergency use requirement.

A Second Example, U.S. Pat. No. 3,944,021 to Smith, Jr. et al. teaches an escape system designed for use with multi-story buildings. The system comprises a generally cylindrical (or other suitable geometric shape) vertical column, preferably attached vertically adjacent to the outside of the building, which is longitudinally slotted on one side to form a main descent channel and which has mounted within it a series of helical lead screws which are fitted together to form one continuous worm shaft. A carrier seat (or harness) unit, which comprises, in part, a seat unit in the form of a net, a hook-up unit in the form of a ball or other suitable geometric shape, is adapted to readily engage within, and descend, at a controlled rate in, the above-mentioned apparatus. People responding to a fire alarm will step through the leg opening in the seat unit and then place the hook-up unit of the carrier seat (or harness) unit, into the slotted channel of a feeder tube (exit lead unit) which extends from an area inside the window to the main descent channel adjacent the window. The carrier seat unit, while carrying the person by means of the net, is then designed to slide, by gravity, through the feed tube and to the main column. The carrier unit then indexes in the main descent channel within the column and descends along the shoulders of the motor-driven rotating helical screw until it nears the bottom of the slot at which time appropriate means are provided for disembarkation. The orderly means of escape described above can be accomplished without the use of existing stair or elevators.

A Third Example, U.S. Pat. No. 3,980,155 to Campbell teaches & fire escape for use in multi-storied building having floors spaced generally equally from adjacent floors at floor spacing. Fire escape has fire resistant, vertical, hollow outer column and similar inner column positioned generally centrally within outer column. Outer and inner columns have generally oval-sectioned inner and outer wall respectively spaced apart to provide columnar space therebetween. Chute within columnar space follows generally helical path of essentially constant pitch of twice floor spacing so that one complete circuit of chute passes two floors. In one embodiment for wide floor spacing, inner column is hollow and has column floors disposed therein level with floor outside outer column and spiral stairway spaced above chute to follow chute with sufficient head room for persons on the chute or stairway. Person escaping enters outer column through door opening, and can descend stairs directly; or through openings in inner column can descend by chute. In second embodiment for narrower floor spacing, a columnar space contains chute and stairway arrange side by side having equal helical pitches, stairway spaced outwards from chute. Dividing wall between chute and stairway prevents interference between persons using chute or stairway. Opening through outer column permits access to stairs, and opening through dividing wall permits access to chute. In both embodiments a second complementary chute and stairway can be provided so that each embodiment has four independent escape routes.

A Fourth Example, U.S. Patent No. 4,267,900 to Yin-Lung teaches an emergency escape system designed for use with multistory buildings. The system comprises generally a vertical zigzag track formed by a plurality of special contour structures, each structure having three plies of plate mounted in parallel relationship adjacent to outside wall of the building and having a plurality of parallel branch tracks extending laterally and slightly upwardly from the vertical track to an exit tunnel at each floor of the building. A number of loader cars for carrying escapees or properties from each exit tunnel along the track to escape, each car having four universal wheels underneath the bottom of the car and two parallel axles perpendicularly fixed at the upper and the lower end back side of the car, a set of several ball bearing rollers connected each other by specially curved springs is rotatorily mounted on each axle for supporting and traveling along the tracks. A group of special contour retaining bars pivotly mounted between the parallel plates of the track for automatic sequence control of the traveling cars. A spring damper located at each turning point or corner of the track for dampening the speed of the traveling car.

A Fifth Example, U.S. Pat. No. 4,556,123 to Hargest, III teaches an evacuation system for non-ambulatory patients from a multistory hospital or the like. A trackway is securable to a wall of a stairwell and includes a hanger rail support. A hanger is rotatably associable with the hanger rail support and has elongated elements suspended from same for securement to a wheelchair, stretcher, or the like. A brake system is associated with the hanger to normally brake roller, wheels or the like of same against movement. A brake release apparatus is operatively associated with the brake system from the hanger for actuation by a patient or attendant to permit the hanger to carry the patient along the trackway.

A Sixth Example, U.S. Pat. No. 4,865,155 to Montaigne, et al. teaches an external elevator system which piggy backs a first rail car on a second rail car to permit simple and rapid transfer of the first rail car to an upper setback section of a high-rise building. Each rail car is equipped with pinion drives that engage racks fixed to vertical rails that are attached to the faces of the base section and setback section of the buildings. The cars also have motor driven wheels that allow the car to drive on horizontal surfaces.

A Seventh Example, U.S. Pat. No. 5,127,491 to Just-Buddy teaches a fire/rescue system which overcomes the deficiencies of internal and fire escapes by providing a plurality of compartments which are mounted to traverse the vertical side walls of a high-rise building to carry individuals from designated locations, vertically distributed along the side walls of the building, to safety of the base of the building. The compartments are stored prior to use and between uses on the roof of the high-rise building, preferably within a specially-designed garage therefor, thus overcoming the aesthetic deficiencies of external fire escapes. In the event a fire and/or smoke sensing device is activated within the building, one or more of the compartments is ejected from the rooftop storage facility and transverses down the exterior wall(s) of the building. The control system for each compartment is programmed so that the compartment stops briefly at each of certain designated floors to pick up passengers and gradually descends all the way to the ground floor to allow its occupants to exit therefrom. The compartment is then quickly returned to a predesignated point along the side wall of the building, for example adjacent the roof, to repeat the descending/passenger pick-up process. The compartments may also be controlled so as to carry one or more firemen from the ground to various floors of the building to facilitate fire-fighting from the exterior.

It is apparent that numerous innovations for emergency escape systems have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

Accordingly, an object of the present invention is to provide an emergency tower escape system for a building having multiple floors that avoids the disadvantages of the prior art.

Another object of the present invention is to provide an emergency tower escape system for a building having multiple floors that is simple to use. A plurality of bridgewalks extends from a plurality of towers to the multiple floors of the building, respectively. A plurality of towers includes outer shell walls rising parallel to, and spaced from, the building having a plurality of entrances that align and communicate with the multiple floors of the building, respectively, by the plurality of bridgewalks, respectively, a plurality of spiral chutes contained therein and communicating with the plurality of entrances, respectively, so as to allow access thereto from the plurality of bridgewalks, respectively, and which are either concentrically or tandemly disposed to each other, a plurality of tracks built into the plurality of spiral chutes, respectively, and a plurality of cars running on a plurality of spiral tracks and carrying evacuees a plurality of bridgewalks down the plurality of spiral tracks to safety.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawing are briefly described as follows:

FIG. 2 is a diagrammatic top plan view taken generally in the direction of arrow 2 in FIG. 1;

FIG. 3 is an enlarged diagrammatic partial cross sectional view taken along line 3—3 in FIG. 1;

LIST OF REFERENCE NUMERALS UTILIZED IN THE DRAWING

Figure 1:
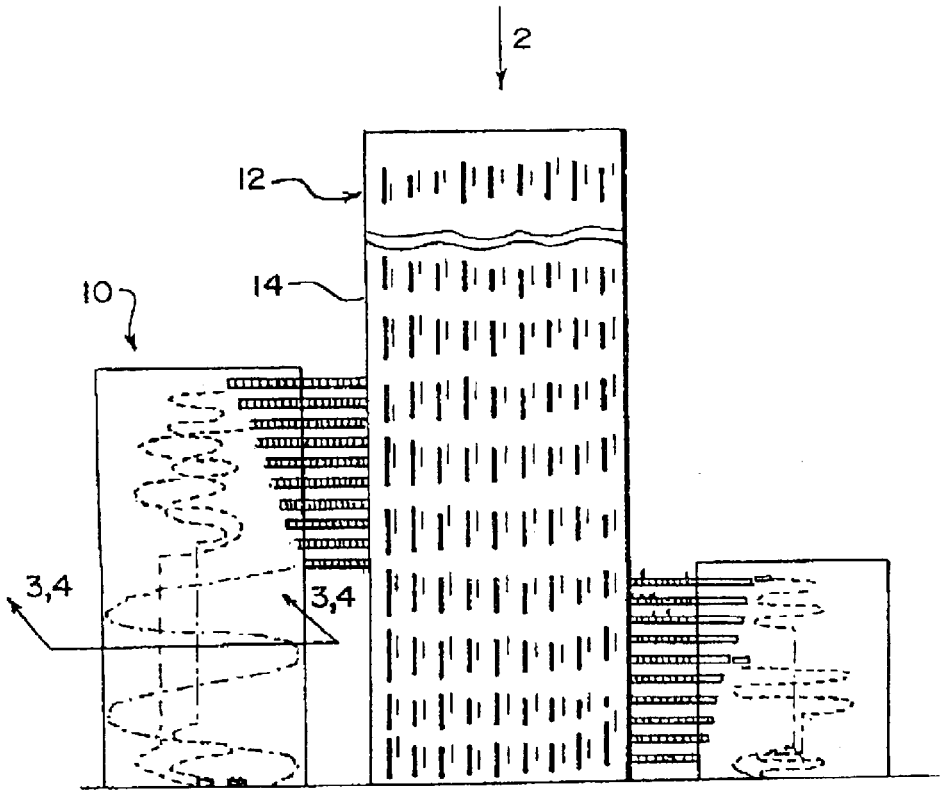
FIG. 1 is a diagrammatic side elevational view of the present invention in use on a building having multiple floors.
Figure 6:
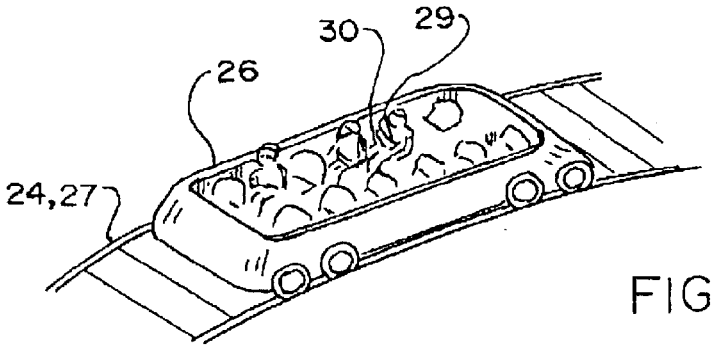
FIG. 6 is an enlarged diagrammatic perspective view of the area generally enclosed by the dotted curve identified by arrow 6 in FIG. 5 of a car of the present invention.
Figure 4:
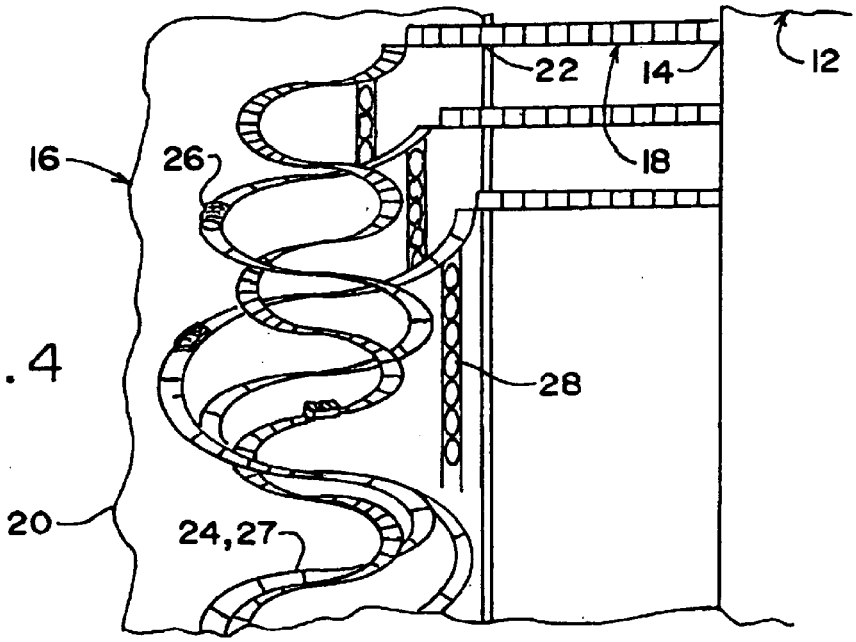
FIG. 4 is an enlarged diagrammatic partial cross sectional view taken along line 4—4 in FIG. 1.
Figure 5:
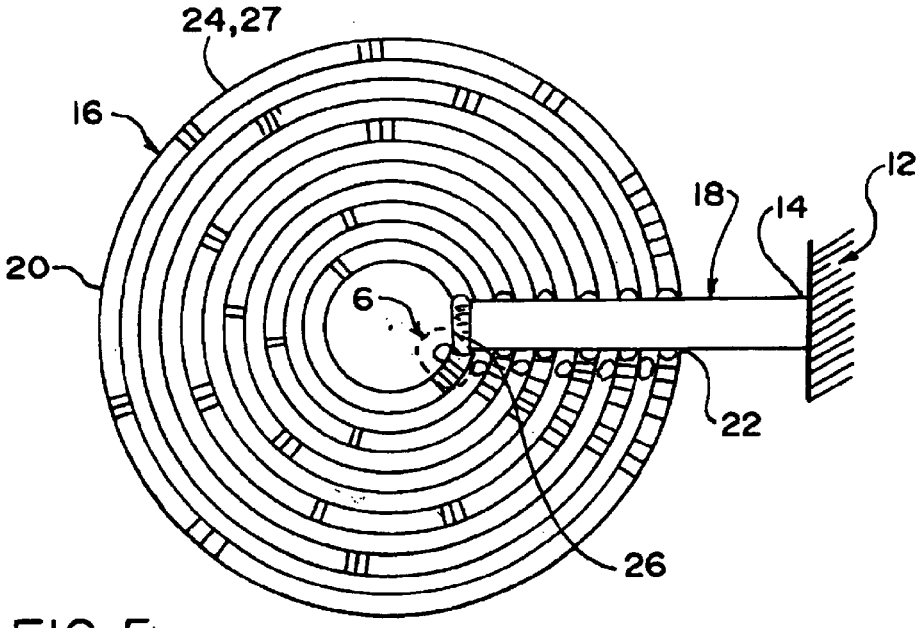
FIG. 5 is a diagrammatic top plan view taken generally in the direction of arrow 5 in FIG. 3.

10 emergency tower escape system of present invention for building 12 multiple floors 14
12 building
14 multiple floors 14 of building 12
16 a plurality of towers
18 plurality of bridgewalks for extending to multiple floors 14 of building 12, respectively
20 outer shell walls of a plurality of towers 16 for rising parallel to, and spaced from, building 12
22 a plurality of entrances in outer shell walls 20 a plurality of towers 16 for aligning and communicating with multiple floors 14 of building 12, respectively, by a plurality of bridgewalks 18, respectively
23 doors protecting plurality of entrances 22 in outer shell walls 20 a plurality of towers 16, respectively
24 plurality of spiral chutes of a plurality of towers 16
25 fire alarms protecting plurality of entrances 22 in outer shell walls 20
26 a plurality of cars of 16 a plurality of towers 16 for carrying evacuees from plurality of bridgewalks 18 down plurality of spiral tracks 27 of a plurality of towers 16 to safety
27 plurality of tracks of a plurality of towers 16
28 plurality of hoists a plurality of towers 16
29 safety belts of a plurality of cars 26 of a plurality of towers 16
30 safety handles of a plurality of cars 26 of a plurality of towers 16

DETAILED DESCRIPTION OF THE PREFERRED EMBODIMENT

Referring now to the figures, in which like numerals indicate like parts, and particularly to the FIGS. 1 and 2, the emergency tower escape system of the present invention is shown generally at 10 for a building 12 having multiple floors 14.

The configuration of the emergency tower escape system 10 can best be seen in FIGS. 3–6, and as such, will be discussed with reference thereto.

The emergency tower escape system 10 comprises a plurality of towers 16 and a plurality of bridgewalks 18. The plurality of bridgewalks 18 extend from a plurality of towers 16 and are for extending to the multiple floors 14 of the building 12, respectively.

A plurality of towers 16 comprises shell walls 20. Outer shell walls 20 of each tower of a plurality of towers 16 is for rising parallel to, and spaced from, the building 12.

The outer shell walls 20 of a plurality of towers 16 is cylindrically shaped and made from reinforced concrete with fireproof reinforced beams.

The outer shell walls 20 of a plurality of towers 16 has a plurality of entrances 22 thereto. The plurality of entrances 22 in the outer shell walls 20 a plurality of towers 16 for aligning and communicating with the multiple floors 14 of the building 12, respectively, by the plurality of bridgewalks 18, respectively.

The plurality of entrances 22 are protected by doors 23 and fire alarms 25, respectively.

A plurality of towers 16 further comprises a plurality of spiral chutes 24, which are either concentrically disposed or tandemly disposed to each other. The plurality of spiral chutes 24 are contained within the outer shell walls 20 and communicates with the plurality of entrances 22, respectively, so as to allow access thereto from the plurality of bridgewalks 18, respectively.

The plurality of spiral chutes 24 are made from fireproof hard plastic reinforced with fireproof padding.

A plurality of towers 16 comprises a plurality of tracks 27. The plurality of tracks are built into the plurality of spiral chutes 24, respectively.

A plurality of towers 16 comprises a plurality of cars 26. A plurality of cars 26 runs on a plurality of spiral tracks 27 and is for carrying evacuees from an a plurality of bridgewalks 18 plurality of tracks 27 to safety.

Each tower 16 further comprises a plurality of cars 26. Each car 26 runs on an associated spiral track 27 and is for carrying evacuators from an associated bridge walk 18 down the associated spiral track 27 to safety.

A plurality of cars 26 has safety belts 29 and safety handles 30. A plurality of towers 16 further comprises a plurality of hoists 28 extending vertically in a plurality of towers 16. A plurality of hoists 28 communicates with a plurality of spiral tracks 27, and hoists a plurality of cars 26 back up to the plurality of spiral tracks 27 for next use.

It will be understood that each of the elements described above, or two or more together, may also find a useful application in other types of constructions differing from the types described above.

While the invention has been illustrated and described as embodied in an emergency tower escape system for a building having multiple floors, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. All emergency tower escape system for a building having multiple floors comprising:

a) plurality of towers, b) a plurality of bridgewalks, wherein said plurality of bridgewalks extend from said plurality of towers, and wherein said plurality of bridgewalks are for extending to the multiple floors of the building, respectively; and c) a plurality of spiral chutes built into a respective interior structure of each of said plurality of towers, wherein each of said spiral chutes communicates with a respective one of said plurality of bridgewalks, so as to allow access thereto from respective entrances of the building floors, d) a plurality of tracks, wherein said plurality of tracks are built into said plurality of spiral chutes, respectively, e) a plurality of cars, wherein said plurality of cars runs on said plurality of spiral tracks; and wherein said plurality of cars is for carrying evacuees from said plurality of associated bridgewalks down said plurality of associated spiral tracks to safety.

2. The system as defined in claim 1, wherein said plurality of towers comprises a plurality of outer shell walls, wherein said outer shell walls of said plurality of towers vertically extend parallel to the building; and wherein outer shell walls of a plurality of towers vertically extend spaced from the building.

3. The system as defined in claim 2, wherein said outer shell walls of said plurality of towers is cylindrically shaped; and wherein said outer shell walls of said plurality of towers is made from reinforced concrete with fireproof reinforcement beams.

4. The system as defined in claim 2, wherein said outer shell walls of said plurality of towers has a plurality of entrances thereto; wherein said plurality of towers has a plurality of entrances thereto; wherein said plurality of entrances in said outer shell walls of a plurality of towers are for aligning with the multiple floors of the building; and wherein said plurality of entrances in outer shell walls of a plurality of towers are for communicating with the multiple floors of the building, respectively, by said plurality of bridgewalks, respectively.

5. The system as defined in claim 4, wherein a plurality of entrances are protected by doors, respectively; and wherein said plurality of entrances are protected by fire alarms, respectively.

6. The system as defined in claim 1, wherein said plurality of spiral chutes are concentrically disposed to each other.

7. The system as defined in claim 1, wherein said plurality of spiral chutes are concentrically disposed to each other.

8. The system as decided in claim 1, wherein said plurality of spiral chutes are made from fireproof hard plastic reinforced with hard padding.

9. Tile system as defined in claim 1, wherein each of said plurality of cars has safety belts and safety handles.

10. The system as defined in claim 1 wherein each of said plurality of towers consists essentially of a plurality of hoists; wherein said plurality of hoists extend vertically built into the interior structure of said plurality of towers; wherein said plurality of hoists communicate with a respective one of said plurality of spiral tracks; and wherein said plurality of hoists hoist a respective one of said associated plurality of cars back up said associated plurality of spiral tracks for next use.

* * * * *